United States Patent [19]

Melek

[11] Patent Number: 4,724,334

[45] Date of Patent: Feb. 9, 1988

[54] MONEY-OPERATED UNIT CONTROL SYSTEM

[76] Inventor: Bernard Melek, 92 Dunthorne Court, Scarborough, Ontario, Canada, M1B 2S9

[21] Appl. No.: 27,907

[22] Filed: Mar. 19, 1987

[51] Int. Cl.[4] ..... G07F 13/00

[52] U.S. Cl. ..... 307/113; 307/38; 200/DIG. 3; 194/220; 194/240

[58] Field of Search ..... 307/38, 112, 113, 114, 307/115, 116, 117, 118, 106; 200/DIG. 3, 331, 17 R; 194/215-230, 239-249, 294, 297, 304, 306, 307, 314, 315, 316

[56] References Cited

U.S. PATENT DOCUMENTS

| | | | |
|---|---|---|---|
| 3,066,245 | 11/1962 | Baker et al. . | |
| 3,191,737 | 6/1965 | James et al. | 194/220 X |
| 3,340,979 | 9/1967 | Howard | 194/240 |
| 3,367,467 | 2/1968 | Ptacek | 194/220 X |
| 3,587,808 | 6/1971 | Romanowski | 194/13 |
| 3,770,089 | 11/1973 | Verduin et al. | 194/221 X |
| 3,828,903 | 8/1974 | Levasseur | 194/215 |
| 3,921,854 | 11/1975 | Formica et al. | 222/16 |
| 3,924,719 | 12/1975 | Bowman | 194/240 |
| 4,094,398 | 6/1978 | Camp et al. | 194/241 |
| 4,220,235 | 9/1980 | Lindsey et al. | 194/240 |
| 4,354,616 | 10/1982 | Camp | 194/219 X |
| 4,555,639 | 11/1985 | Melek | 307/38 |

*Primary Examiner*—William M. Shoop, Jr.
*Assistant Examiner*—Paul Ip
*Attorney, Agent, or Firm*—Jones, Tullar & Cooper

[57] ABSTRACT

A money operated control is used to control and operate a selected one of a plurality of electrical units such as washing, drying or gas-dispensing machines. Each such unit includes a unit controller device operable to control the functioning of the unit upon delivery of a start signal to the unit controller device. A central control panel includes a latching relay which when pulsed to its set state energizes a transformer. The transformer in turn energizes a switching unit in the central control panel which selects one of the electrical units to be energized. The actuation of the selected electrical unit resets the latching relay to its original condition and additional relay circuitry is provided so that the connection to the machine in use does not interfere with subsequent operation of the control panel to select other machines.

14 Claims, 2 Drawing Figures

MONEY-OPERATED UNIT CONTROL SYSTEM

BACKGROUND OF THE INVENTION

This invention relates to a central control device for controlling the selection or operation of a plurality of electrical units. In particular, the invention relates to a central control device which may be actuated by coins or bills.

Applicant's prior U.S. Pat. No. 4,555,639 issued Nov. 26, 1985 illustrates a form of central control device for use in controlling independent units such as washing machines and drying machines in a laundromat or gasoline pumps. Each individual electrical unit is provided with its own timing system in the case of washing machines or dispensing system in the case of gasoline pumps but operation is initiated from a central control panel which includes a money acceptor device.

To operate a selected electrical unit the customer inserts appropriate coins in the coin acceptor, actuates the central control panel to identify a particular unit and initiates operation of the selected unit.

SUMMARY OF THE INVENTION

The invention relates to a central control panel in which a latching relay is connected in series, with a coin acceptor unit across the line and neutral supply. When the latching relay is pulsed to its set state it energizes the transformer also connected across the line and neutral supply. The transformer in turn energizes a switching unit in the central control panel which selects one of the electrical units to be energized. The actuation of the selected electrical unit resets the latching relay to its original condition and additional relay circuitry is provided so that the connection to the machine in use does not interfere with subsequent operation of the control panel to select additional machines.

Thus, the present invention provides a central control unit having a different arrangement of electrical circuitry from that illustrated in my prior patent in that it is adapted to use more than one coin acceptor, an isolating transformer is used which avoids short circuiting of input lines and an impulse relay is employed for greater certainty in the switching process.

DESCRIPTION OF THE PREFERRED EMBODIMENTS

Figure 1:
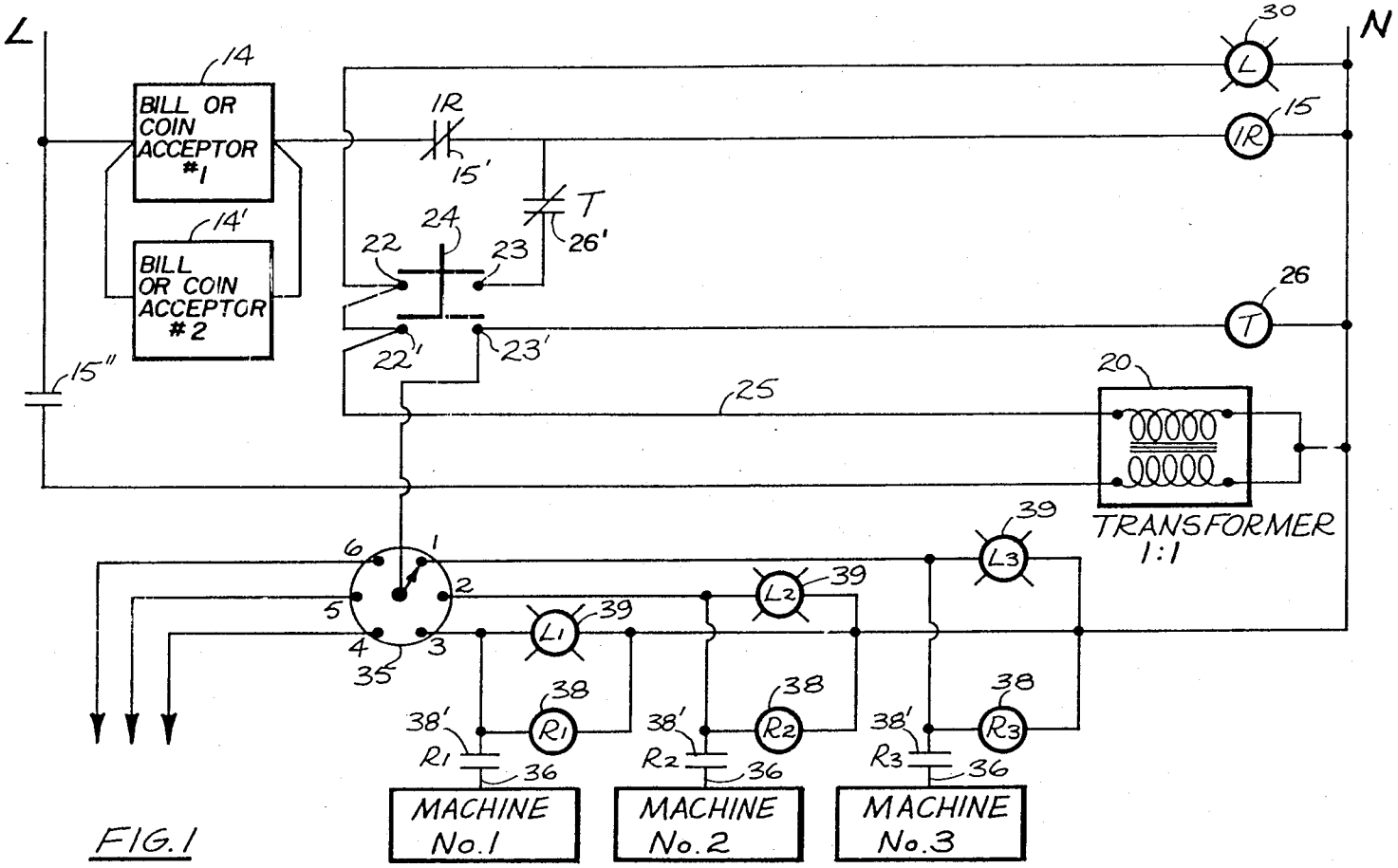
FIG. 1 is a wiring diagram of one embodiment of the control panel.

FIG. 1 discloses a control system supplied with electrical power from a conventional source having line (L) and neutral (N) terminals. A coin or bill acceptor 14 is arranged in series with a normally-closed relay contact 15' and a latching relay coil 15, the series assembly being positioned between power lines L and N. Also connected between power lines L and N is a normally-open contact 15'' of relay 15 arranged in series with the primary winding of a transformer 20. Several coin or bill acceptors 14, 14' can be used connected in parallel. The insertion of the correct amount in any one of them establishes contact briefly between its terminals.

When coins totalling a suitable amount are inserted in one of the coin acceptors 14, it briefly couples line L to conductor 16 and hence through contact 15' to relay coil 15. This actuates relay 15 to latch to its other state with contact 15' open and contact 15'' closed, thus connecting transformer 20 between the lines L and N. The secondary winding of transformer 20 has one end connected to power line N and the other end connected by conductor 25 to terminals 22 and 22' of a push-button switch 24. An indicator light 30 is connected between the coupled terminals 22, 22' and power line N. Thus, when transformer 20 is energized, the voltage at the secondary winding is connected through conductor 25 to terminals 22 and 22' and indicator light 30 illuminated to show that the unit is active. Push button switch 24 has terminals 23 and 23' adapted to be connected to terminals 22 and 22' respectively when the switch is closed.

With power now available at contacts 22 and 22', as shown by the illumination of light 30, the user then selects a particular machine by means of a rotary switch 35. The wiper of switch 35 is connected to terminal 23' of push-button switch 24 and thus is energized on actuation of the push-button. The terminals of the rotary switch are connected to conductors 36, one for each machine, through normally-open relay contacts 38'.

Conductor 36 extending from each machine serves the purpose both of initiating operation of the machine and indicating that it is in operation. As explained in my earlier U.S. Pat. No. 4,555,639, the connection of power to conductor 36 functions as a singal to initiate operation of the machine by starting a timer in the machine which controls its subsequent operation. The machines derive power from lines L and N although this connection is not shown. While the machine is in operation it provides a signal on conductor 36 derived from power line L.

Each conductor 36 is connected back to power line N through a series connection of a relay 38 and its associated normally-open contact 38'. A further indicator lamp 39 is connected between each rotary switch contact and power line N.

When the user depresses push-button 24, contact 23' is energized and the relay 38 associated with the selected machine actuated. This pulls in its associated contact 38' and initiates operation of the machine under the control of its own timer and power supply. Because conductor 36 is energized during the machine operation, it holds relay 38 in its energized condition and also illuminates lamp 39 to show that the particular machine is in use. This indication persists regardless of subsequent operations of the rotary switch as long as the particular machine continues in operation under the control of its own timer. When the machine terminates operation, the power signal on conductor 36 ceases, relay 38 drops out and lamp 39 is extinguished.

Thus, when the user selects a particular machine by means of rotary switch 35 and actuates push-button 24 operation of the machine is initiated. The remaining circuitry not yet described functions to restore the selection circuitry to its original state so that another user can select a machine in a similar fashion. To achieve this, terminal 23 has a timing relay 26 connected between it and power line N. A normally-closed contact 26' of relay 26 is connected between terminal 23 and the junction of relay 15 and contact 15'.

In normal operation, when push-button 24 is actuated an energizing signal supplied to latching relay 15 via contact 26' restores this relay 15 to its initial condition with contacts 15' closed and 15'' open. Timing relay 26 then opens contacts 26' after a delay so that no further signal can travel that path until relay 26 is released. Relay 26 is released when rotary switch 35 is moved away from the terminal associated with the machine in operation, since the terminal remains energized while the machine is in operation. Thus, a subsequent user cannot select a machine already in use. When push-button 24 is not depressed terminals 23 and 23' are isolated from one another, thereby ensuring that contacts relay 15, through contacts 26' cannot inadvertently be energized by contact to a machine in operation.

Figure 2:
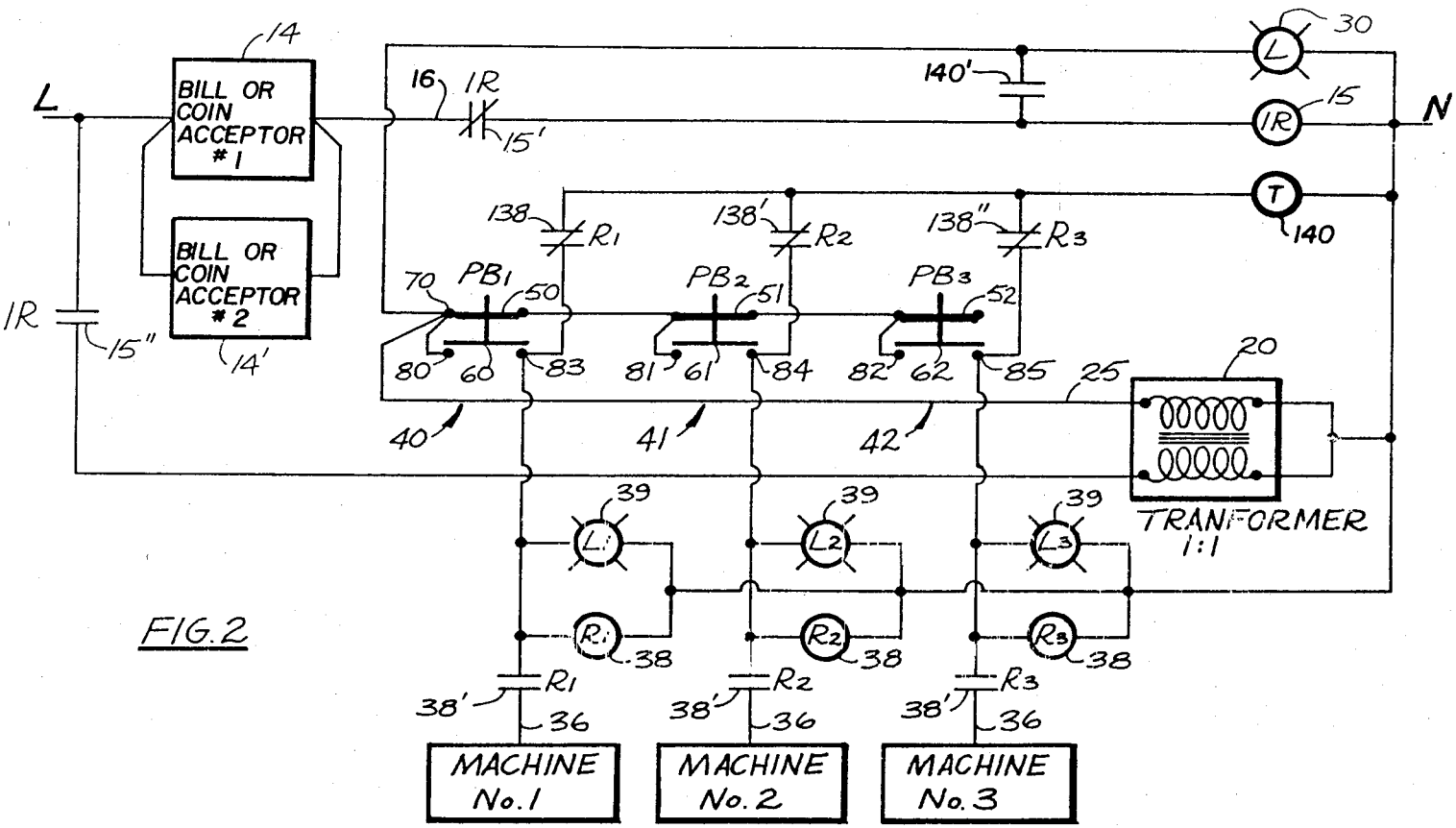
FIG. 2 is a wiring diagram of a different embodiment of the control panel.

FIG. 2 shows a variation of the control panel of FIG. 1 in which the rotary switch 35 is replaced by an assembly of push-button switches 40, 41 and 42, each associated with one of the machines. Push-button switch 40 consists of a normally-closed section 50 and a normally-open section 60. Similarly, switches 41 and 42 have normally closed sections 51, 52 and normally-open sections 61, 62, respectively.

Terminal 70 of push-button switch 40 is connected to the transformer secondary by conductor 25. Terminal 70 in turn is directly connected to terminal 80 of the normally-open section 60 of push-button switch 40 and indirectly connected to corresponding terminals 81 and 82 of push-button switches 41 and 42 through the normally-closed sections 50, 51 and 52. The opposite terminals 83, 84 and 85 of the normally-open sections are each connected to one of the machines. As previously described with reference to FIG. 1, this connection is to conductor 36 through a normally-open contact 38' of relay 38. Relay 38 is provided with three additional normally-closed contacts designated 138, 138' and 138". These relay contacts each connect one of terminals 83, 84 and 85 to a timing relay 140 having its other terminal connected to power line N. Normally open contacts 140' of relay 140 are connected between terminal 70 and the junction of relay contact 15' and relay 15.

When transformer 20 is energized by the insertion of the correct coin deposit in coin acceptor 14 or 14' each of terminals 80, 81 and 82 is energized and indicator light 30 illuminated. The user then selects the push-button switch corresponding to the desired machine and on actuation of that switch, the corresponding relay 38 is energized and the machine operated via conductor 36. As before, conductor 36 stays energized under the control of the machine timer which keeps relay 38 actuated.

On actuation of the selected push-button a restore signal is supplied to timing relay 140 from terminal 83, 84 or 85 via relay contacts 138, 138' or 138". This in turn resets relay 15 to its original position via the connection through contact 140' and removes energization from the primary of transformer 20. After relay 38 of the selected machine is actuated, the normally-closed contact between the actuated one of terminals 83, 84 and 85 and relay 140 is held open thereby avoiding any actuation of relay 140 through that path. That is, when a machine is in operation, depression of the associated push-button will not have any effect in resetting latching relay 140 since the path through contact 138' is open.

I claim:

1. A central control panel to be connected to a source of electric power defining at least two power lines and a plurality of electrical units, each said unit including a unit controller device operable to control the functioning of the unit upon delivery of a start signal to the unit controller device, the start signal being a signal from a pre-determined line of the power source, wherein the control panel comprises:

a latching relay having a normally-open contact and a normally-closed contact, a condition responsive unit having a pair of terminals and including means to connect the terminals on occurrence of said condition, said latching relay, said normally-closed contact and said condition responsive unit being connected in series across said power lines, a transformer having a primary and a secondary winding, said primary winding and said normally-open contact being connected in series across said power lines, whereby on occurrence of said condition said latching relay latches to close said normally-open contact, and said transformer is energized, a rotary switch, a push-button switch operable to connect the secondary winding of the transformer to the wiper of the rotary switch, a plurality of holding relays, one for each electrical unit, each said holding relay having a normally-open contact connected between an output terminal of the rotary switch and a unit controller device of the corresponding electrical unit, each said holding relay being connected between the output terminal of the rotary switch and a power line, whereby on actuation of the push-button switch, a start signal is delivered to the unit controller device of the electrical unit defined by the rotary switch.

2. The central control panel as defined in claim 1 further including a timing relay having a normally-closed contact, said timing relay being connected between said push-button switch and a power line, said normally-closed contact being connected between the side of the latching relay remote from the power line and the secondary winding of the transformer via a contact of said push-button switch.

3. The central control panel as defined in claim 1 wherein said condition responsive unit is a money acceptor mechanism.

4. A central control panel as claimed in claim 3, wherein the electrical units are washing machines and drying machines.

5. A central control panel as claimed in claim 3, wherein the electrical units are gasoline pumps.

6. The central control panel as defined in claim 1 further including an indicator light connected across the secondary winding of said transformer.

7. The central control panel as defined in claim 1 further including a plurality of indicator lights, each connected across one of said holding relays.

8. A central control panel to be connected to a source of electric power defining at least two power lines and a plurality of electrical units, each said unit including a unit controller device operable to control the functioning of the unit upon delivery of a start signal to the unit controller device, the start signal being a signal from a pre-determined line of the power source, wherein the control panel comprises:

a latching relay having a normally-open contact and a normally-closed contact, a condition responsive unit having a pair of terminals and including means to connect the terminals on occurrence of said condition, said latching relay, said normally-closed contact and said condition responsive unit being connected in series across said power lines, a transformer having a primary and a secondary winding, said primary winding and said normally-open contact being connected in series across said power lines, whereby on occurrence of said condition said latching relay latches to close said normally-open contact, and said transformer is energized, a plurality of electrical switch means, one for each electrical unit, each switch means comprising a normally-closed switch and a normally-open switch, said normally-closed switches being connected in series to the secondary winding of said transformer, said normally-open switches each having a first terminal connected to the series connection of the normally-closed switches, a plurality of holding relays, one for each electrical unit, each holding relay having a normally-open contact connected between a second terminal of the normally-open switch and a unit controller device of the corresponding electrical unit, each holding relay having a winding connected between said second terminal of the normally-open switch and a power line, a push-button actuator for each switch means operable to connect the secondary winding of said transformer to said second terminal of the normally-open switch, whereby on actuation of one of said push-button switches, a start signal is delivered to the corresponding unit controller device.

9. The central control panel as defined in claim 8, wherein each holding relay has a normally-closed contact connected between said second terminal of the corresponding normally-open switch and the side of the latching relay remote from the power line.

10. The central control panel as defined in claim 8 wherein said condition responsive unit is a money acceptor mechanism.

11. A central control panel as claimed in claim 10, wherein the electrical units are washing machines and drying machines.

12. A central control panel as claimed in claim 10, wherein the electrical units are gasoline pumps.

13. The central control panel as defined in claim 8 further including an indicator light connected across the secondary winding of said transformer.

14. The central control panel as indicated in claim 8 further including a plurality of indicator lights, each connected across one of said holding relays.

* * * * *